US005160506A

United States Patent [19]

Schur et al.

[11] Patent Number: 5,160,506

[45] Date of Patent: Nov. 3, 1992

[54] LIQUID FUEL MIXTURE, METHOD FOR ITS PRODUCTION, AND IS USE FOR TWO-STROKE ENGINES

[76] Inventors: Hans Schur, Weidenstrasse 2, 7432 Bad Urach; Werner Angerer, Keltenstrasse 21, 8029 Sauerlach; Friedrich Sprügel, Solalindenstrasse 36b, 8000 München 82, all of Fed. Rep. of Germany

[21] Appl. No.: 552,041

[22] Filed: Jul. 13, 1990

[30] Foreign Application Priority Data

Jul. 25, 1989 [DE] Fed. Rep. of Germany ..... 3924583

[51] Int. Cl.[5] ..... C10L 1/18

[52] U.S. Cl. ..... 44/308; 44/307; 44/388; 44/389; 44/447; 44/448; 44/459

[58] Field of Search ..... 44/307, 308, 388, 389, 44/447, 448, 459

[56] References Cited

U.S. PATENT DOCUMENTS

| | | | |
|---|---|---|---|
| 3,361,544 | 1/1968 | Kaiser, Jr. | 44/448 |
| 4,177,040 | 12/1979 | Kaiser, Jr. | 44/448 |
| 4,844,713 | 7/1989 | Yu | 44/307 |

FOREIGN PATENT DOCUMENTS

| | | | |
|---|---|---|---|
| 044006 | 4/1974 | Japan | 44/388 |

OTHER PUBLICATIONS

Abstract, "Studies of eucalyptus oil and its application to spark ignition engine III", Bull. Fac. Agr. Mie Univ., Nr. 62, 1981.

*Primary Examiner*—Ellen McAvoy
*Attorney, Agent, or Firm*—Iver P. Cooper

[57] ABSTRACT

The invention relates to a liquid fuel mixture, comprising a $C_3$ and/or at least a $C_4$-alkane, at least one oil component and optionally at least one additive, a process for its preparation and its use for two-stroke engines.

24 Claims, No Drawings

LIQUID FUEL MIXTURE, METHOD FOR ITS PRODUCTION, AND IS USE FOR TWO-STROKE ENGINES

DESCRIPTION

The invention relates to a liquid fuel mixture, a method for its production, and the use of this fuel mixture for two-stroke engines.

The conventional liquid fuels for internal combustion engines consist of mixtures of hydrocarbons and are mainly derived from mineral oils. In view of the limited mineral oil reserves and the development of the costs for crude oils there is a demand for fuels which could replace petrol hydrocarbons or would permit the existing resources to be more effectively used.

The heavy environment pollution by the pollutant components contained in the exhaust gases of internal combustion engines, specifically hydrocarbons, carbon monoxide, nitric oxides ($NO_x$) and sulphur oxides ($SO_x$), has since long ago been conductive to an extensive search for alternative, less noxious fuels capable of replacing petrol-based fuels.

It is therefore an object of the present invention to provide a fuel the combustion of which results in the production of low-pollutant exhaust gases.

This object is attained by the provision of a liquid fuel mixture containing a $C_3$- and/or at least one $C_4$-alkane and at least one oil component selected from the group of biologically decomposable synthetic oils and/or vegetable oils and/or animal oils, with the weight ratio of oil component: alkane lying within the range of 1:20 to 1:250, and optionally at least one additive.

It has been unexpectedly found that the combination of a $C_3$- and/or at least one C4-alkane with at least one oil component according to the invention results in a considerable reduction of the pollutant contents of exhaust gases when employed in internal combustion engines.

The fuel mixture according to the invention contains $C_3$- and/or $C_4$-alkanes such as propane, butane or isobutane, these alkanes being obtained as by-products in the oil refining industry when distilling and cracking crude oil, and in the natural gas industry in the petrol separation process. The invention permits propane, butane and isobutane to be employed separately or in the form of any mixture, the mixture being less expensively available, however, as it is obtained directly in the petroleum refining process. For this reason it is preferred to employ a mixture of propane and butane. A high butane content has been found advantageous when using the fuel mixture at low temperatures.

The evaporation of the gaseous components causes a considerable cooling-down of the fuel mixture. For ensuring that the fuel mixture remains in a suitable state for use as it cools, the mixture of the oil component and the additive should have a setting point of no more than −35° C. The setting point of these additives lies preferably in the range of −40° to −50° C.

The employed oil component may be a biologically decomposable synthetic oil. This has a particularly favourable influence on the exhaust gas composition, since synthetic oils have only a low content of unsaturated or polycyclic aromatic compositions, and only traces of impurities containing nitrogen, sulphur or oxygen.

The synthetic oil preferably comprises at least one polymer oil, for instance ethylene polymers, propylene polymers etc., and corresponding copolymers. These substances are more reliable at low temperatures than mineral oils, they have low setting point, are highly resistant to oxidation and thermically stable, and in addition exceptionally suitable for mixing with mineral oils.

The synthetic oil preferably comprises at least one polyether oil, since such oils have very low setting and boiling points.

The synthetic oil moreover preferably comprises at least one ester oil such as a mono-, di-, tri- and polyester oil. Ester oils have low setting points and high flash points and are readily mixable with hydrocarbon oils. The major chain of the alcohol component of the ester suitably contains 4 to 17 hydrocarbons. Suitable for use are for instance ethyl-hexyl oleate, i-butyl oleate, oleic acid-methyl ester, glycerine-tri-caprylate, glycerine-tri-oleate, di-ethyl-hexyl sebacate, di-n-butyl adipate, di-n-octylphtalate, neopentylglycol-di-oleate, pentaerythrit-di-oleate, trimethylol propane complex ester, trimethylol propane-tri-oleate, trimethylol propane-tri-aliphatic acid ester and the like. Particularly preferred in this respect are ethyl-hexyl oleate, glycerine-tri-caprylate, di-ethyl-hexyl sebacate and trimethylol-propane-tri-aliphatic acid ester. The employ of these synthetic oils as the oil component in the fuel mixture according to the invention results in the obtention of particularly desirable exhaust gas compositions.

The oil component employed may also be a vegetable oil and/or at least one animal oil, such as rape oil, sunflower oil, castor oil, olive ol, peanut oil, soybean oil, colza oil, jujuba oil, or whale oil, which oils may optionally be blow-refined. The employ of vegetable and/or animal oils as the oil component in the fuel mixture according to the invention results in the obtention of particularly desirable exhaust gas compositions. Any residues of these oils are completely decomposable, so that they do not pollute the environment.

It is possible to employ any mixture of biologically decomposable synthetic oils and vegetable and animal oils. A mixture of jujuba ester, ethyl-hexyl oleate and di-ethyl-hexyl sebacate has been found to be particularly useful.

The fuel mixture according to the invention further contains preferably at least one conventional additive acting as an ageing inhibitor. The additive preferably contains amines and/or liquid amino phenols, whereby a particularly effective ageing inhibition effect is obtained. The employed additive may thus be a commercially available additive consisting of a combination of volatile, linear and aromatic amines with liquid amino phenols dissolved in isopropanol (commercially obtainable from the firm of TUNAP under the designation "Additive Package MR 89119"). This product is described in German patent No. 3924596 and contains 22.25% dimethylformamide, 24.75% morpholine, 2.00% primary alkylamine having 8 to 12 carbon atoms, 2.00% 2,4,6-tri-tert.-nonylphenol and 50% isopropanol. The amount of the additive preferably lies within the range of 50–1000 ppm as related to the weight of the mixture.

The fuel mixture may additionally contain conventional additives such as oxidation inhibitors, setting point lowering compositions, viscosity index improver compositions, detergents, dispersents and corrosion inhibitors. It is optionally also possible to add ash-free additives for the prevention of deposit-formation.

The fuel mixture according to the invention is prepared by providing at least one oil, which may optionally contain at least one additive, in a container under pressure, and by adding thereto a gaseous mixture of a $C_3$- and/or $C_4$-alkane. This will result in the formation of a liquid phase, and of a gaseous phase in the upper part of the container. When the thus formed mixture is being consumed, the resultant pressure drop causes the liquid phase to evaporate accordingly.

The fuel mixture according to the invention is particularly suitable for use in two-stroke engines.

The invention will be more clearly understood from the following examples:

EXAMPLE 1

A fuel mixture was prepared of the following components:

a) 98 parts by weight propane/butane at a ratio of 1:1;
b) 2 parts by weight of a mixture of trimethylol propane tri-aliphatic acid ester and jujuba ester (mixing ratio by weight: 90:10),
c) 250 ppm additive (ADDITIVE PACKAGE MR 89119 of the TUNAP company).

The oil was mixed with the additive and placed in a container. The gaseous mixture was subsequently added under pressure.

EXAMPLE 2

A fuel mixture was prepared in the same manner as in the first example and with the following components:

a) 98 parts by weight butane,
b) 2 parts by weight of a mixture of jujuba ester, ethyl-hexyl oleate and di-ethyl-hexyl sebacate (mixing ratio by weight: 5:30:65),
c) 250 ppm additive (MR 89119 of TUNAP comp.).

EXAMPLE 3

A fuel mixture was prepared in the same manner as in the first example, and with the following components:

a) 99 parts by weight of a gaseous mixture propane/butane at a mixing ratio of 1:1
b) 1 part by weight glycerine-tri-caprylate
c) 100 ppm additive (MR 89119 of TUNAP comp.).

The fuel mixtures prepared in accordance with examples 1 to 3 produced less noxious exhaust gases than petrol-oil mixtures when used in two-stroke engines.

We claim:

1. A liquid fuel mixture, comprising a $C_3$, a $C_4$-alkane or a mixture of $C_3$ and $C_4$-alkanes, and at least one non-fragrant oil component selected from the group consisting of the biologically decomposable synthetic oils, vegetable oils and animal oils, with the weight ratio of oil component: alkane lying within the range of 1:20 to 1:250.

2. A fuel mixture according to claim 1, characterized in that the mixture has a setting point of not above −35° C.

3. A fuel mixture according to claim 2, characterized in that said mixture has a setting point of −40° to −50° C.

4. A fuel mixture according to claim 1, characterized in that said synthetic oil comprises at least one polymer oil.

5. A fuel mixture according to claim 1, characterized in that said synthetic oil comprises at least one polyether oil.

6. A fuel mixture according to claim 1, characterized in that said synthetic oil comprises at least one ester oil.

7. A fuel mixture according to claim 6, characterized in that said ester oil comprises at least one ester selected from the group consisting of at least one monoester, at least one diester, at least one triester and at least one polyester.

8. A method for the production of a liquid fuel mixture according to claim 1, characterized in that at least one non fragrant oil component, optionally in combination with at least one additive, is provided in a container, and a $C_3$-, at least one $C_4$-alkane or a mixture of $C_3$ and $C_4$-alkanes, is added under pressure.

9. The fuel mixture of claim 1, in which none of the oil components of said mixture are fragrant oils.

10. The fuel mixture of claim 1, further comprising an additive acting as an aging inhibitor.

11. A fuel mixture according to claim 10, characterized in that said additive contains amines, liquid amino phenols, or a mixture of both.

12. A fuel mixture according to claim 10, characterized in that the amount of said additive lies within the range of 50 to 1000 ppm as related to the weight of the mixture.

13. The fuel mixture of claim 1, wherein the oil components include jujuba ester, ethyl-hexyl oleate and di-ethyl hexyl sebacate.

14. The fuel mixture of claim 1, wherein the oil components include trimethyol propane tri-aliphatic acid ester and jujuba ester.

15. The fuel mixture of claim 1, wherein the oil components include glycerine-tri-caprylate.

16. The method of claim 1, wherein said fuel mixture, when combusted, further comprises an additive acting as an aging inhibitor.

17. A liquid fuel mixture, containing a $C_3$-, at least one $C_4$-alkane or a mixture of $C_3$ and $C_4$-alkanes, and at least one polyether oil component with the weight ratio of each polyether oil component: alkane lying within the range of 1:20 to 1:250.

18. A liquid fuel mixture, comprising a $C_3$-, at least one $C_4$-alkane or a mixture of $C_3$ and $C_4$-alkanes, and at least one ester oil, with the weight ratio of each ester oil component: alkane lying within the range of 1:20 to 1:250.

19. The fuel mixture of claim 18 wherein said ester oil comprises at least one member selected from the group consisting of at least one monoester, at least one diester, at least one triester and, at least one polyester.

20. A liquid fuel mixture, containing a $C_3$-, at least one $C_4$-alkane or a mixture of $C_3$ and $C_4$-alkanes, and at least one oil component selected from the group consisting of the biologically decomposable synthetic oils, vegetable oils and animal oils, with the weight ratio of oil component: alkane lying within the range of 1:20 to 1:250, and an additive selected from the group consisting of amines and liquid amino phenols.

21. A method of reducing the production of polluting exhaust gases while combusting a liquid, hydrocarbon-containing fuel mixture, which comprises incorporating into a liquid hydrocarbon-containing fuel mixture containing at least one $C_3$ or $C_4$ alkane, at least one oil component selected from the group consisting of biologically decomposable synthetic oils, animal oils, and vegetable oils, with the weight ratio of oil component: alkane lying within the range of 1:100 to 1:250.

22. The method of claim 21, wherein said mixture is added to a two-stroke engine.

23. A method of reducing the production of polluting exhaust gases while combusting a liquid, hydrocarbon-containing fuel mixture, which comprises incorporating into a liquid hydrocarbon-containing fuel mixture containing at least one $C_3$ or $C_4$ alkane, at least one oil component selected from the group consisting of biologically decomposable synthetic oils, animal oils, and vegetable oils, wherein said oil component is present in an amount effective to substantially reduce the concentration in the exhaust gas of one or more pollutants selected from the group consisting of hydrocarbons, nitric oxides, sulfur oxides and carbon monoxide.

24. The method of claim 23, wherein said mixture is added to a two-stroke engine.

* * * * *